United States Patent [19]

Minolla et al.

[11] 4,069,554

[45] Jan. 24, 1978

[54] ADJUSTABLE FITTING FOR SAFETY BELT

[75] Inventors: Horst Minolla, Heidestieg; Uwe Peters, Hamburg, both of Germany

[73] Assignee: Klippan GmbH Hamburg, Hamburg, Germany

[21] Appl. No.: 596,134

[22] Filed: July 15, 1975

Related U.S. Application Data

[63] Continuation of Ser. No. 468,784, May 9, 1974, abandoned.

[30] Foreign Application Priority Data

May 11, 1973 Germany ..... 2323870

[51] Int. Cl.[2] ..... A44B 11/06

[52] U.S. Cl. ..... 24/196; 24/171

[58] Field of Search ..... 24/196, 171, 194

[56] References Cited

U.S. PATENT DOCUMENTS

| | | | |
|---|---|---|---|
| 688,503 | 12/1901 | Cross | 24/171 |
| 1,055,008 | 3/1913 | Wright | 24/194 |
| 2,219,537 | 10/1940 | White | 24/196 |
| 2,542,044 | 2/1951 | Miller | 24/196 |
| 2,573,527 | 10/1951 | White | 24/196 |
| 2,878,540 | 3/1959 | White | 24/196 |
| 2,884,676 | 5/1959 | Finken | 24/171 |
| 2,938,254 | 5/1960 | Gaylord | 24/171 |
| 3,162,915 | 12/1964 | Rosenberg | 24/196 |
| 3,414,947 | 12/1968 | Holmberg | 24/196 |

FOREIGN PATENT DOCUMENTS

| | | | |
|---|---|---|---|
| 731,927 | 2/1943 | Germany | 24/196 |
| 1,153,953 | 6/1969 | United Kingdom | 24/196 |

*Primary Examiner*—Bernard A. Gelak
*Attorney, Agent, or Firm*—Ernest D. Buff

[57] ABSTRACT

Apparatus for the adjustment to various lengths of a belt, preferably of a safety belt on motor vehicles or the like, with a frame having a longitudinal aperture and, displaceable in the frame and transversely with respect to the longitudinal aperture, a thrust piece which has a transverse web with a locking edge set at a small angle to its main plane and lateral guide panels extending transversely to the locking edge.

2 Claims, 13 Drawing Figures

ADJUSTABLE FITTING FOR SAFETY BELT

This is a continuation, of application Ser. No. 468,784, filed May 9, 1974, now abandoned.

The invention relates to an apparatus for the adjustment to various lengths of a belt, preferably of a safety belt on motor vehicles or the like, with a frame having a longitudinal aperture and, displaceable in the frame and transversely with respect to the longitudinal aperture, a thrust piece which has a transverse web with a locking edge set at a small angle to its main plane and lateral guide panels extending transversely to the locking edge.

Adjusting devices or adjustable fittings of the type mentioned at the outset are already widely known. One particular form of embodiment of the prior art is so constructed that the frame provided with the longitudinal aperture has on its narrow lateral surfaces two arms and flanged structure with respect to the longitudinal aperture. As a result, in each case a kind of guide groove is formed on the narrow lateral faces of the frame, in which a thrust piece can be pushed backwards and forwards by means of guide panels transversely with respect to the longitudinal aperture. The thrust piece consists of a steel plate, the form of which is U-shaped in plan view. The transverse web connecting the two arms of the U is in this case at least as long as the longitudinal aperture in the frame, whereas the arms themselves form the said lateral guide panel. One safety belt which is secured in the interior of the motor vehicle, preferably alongside the seat, is guided through the longitudinal aperture, engages around the rear broad side panel of the frame and is then secured on to itself. This is the fixed end at the adjustable fitting. The other belt is inserted from below upwardly on the oppositely disposed front lateral face, is looped around the transverse web of the thrust piece and is pushed downwardly again through the longitudinal aperture. The length of the last-mentioned belt is thereby adjustable in that one or other end of this belt is pulled out through or passed back through the longitudinal aperture, around the transverse web of the thrust piece. For adjustment, it is necessary for the frame to be tipped by a certain angle out of the surface of the safety belt. In case of emergency, i.e. in the event of a vehicle accident, the main plane of the frame is virtually parallel with the plane of the safety belt. The bottom end of the belt which is passed around the thrust piece is guided over the hip or the shoulders of the occupant and must be held fast in the adjustable fitting in the case of an accident. This is achieved in that upon a sudden pull on the lower belt, the thrust piece is drawn forward in the direction of the pull and is moved, relative to the frame, towards the leading edge of the longitudinal aperture. The slit between the said leading edge and between the locking edge of the thrust piece is narrowed by this movement so that a perfect clamping action is guaranteed. This clamping action is released by the aforementioned lifting of the frame, i.e. lifting on one side and oblique positioning, whereby the thrust piece is moved backwardly again.

This known adjustable fitting has two substantial disadvantages:

1. In order to form the guide groove for the lateral guide panels of the thrust piece, the frame must not only be made from a complicated stamped-out piece, but the previously described lateral tongues must be bent over onto the longitudinal aperture in a special working process.

2. The thrust piece has a narrow web which apart from the leading locking edge, disadvantageously and necessarily has a rear edge. When adjusting the length of the belt, i.e. when the frame is inclined with respect to the plane of the belt, the belt has to be pulled around this rear edge. It will be appreciated that in some conditions, according to the material from which the belt is made, considerable tractive force may be necessary to adjust the length of the belt. There are motor vehicle manufacturers who even prescribe the maximum possible pulling force for adjustment of the belt length. Frequently, the known adjustable fitting does not meet these requirements.

Also, an adjustable fitting has been already suggested which has, mounted directly on the vehicle, a U-shaped housing in the lateral members of which, locking rollers are disposed in slots and are longitudinally displaceable in the direction of pull of the belt, the locking rollers having ribbed surfaces to increase the frictional force and thus the clamping force. These adjusting means have advantages in many respects but require also considerable tractive force for adjusting the length of the belt and are in most cases of complicated construction.

Therefore, the problem according to the invention is so to improve a device for adjusting various lengths of a belt of the type mentioned at the outset that without complication or increased cost but with improved safety in an emergency, adjustment, i.e. pulling out of the relevant belt, is facilitated.

According to the invention, the problem is resolved in that the frame with the longitudinal aperture consists substantially of a flat piece of steel sheet, the thrust piece being constructed as a locking cap, the transverse web having an approximately semi-circular cross-section and having on its outside surface offset retaining jaws which are displaceable on the narrow lateral face of the frame transversely to the longitudinal aperture therein.

The transverse web of the thrust member is formed so that the second rear edge of the transverse member is obviated and, in its place, a guide surface for the belt strip is provided, which ensures a diminution of the curvature in the belt at those places around which the belt strip is pulled while the length is being adjusted.

Advantageously, therefore, the measures according to the invention provide for reduced adjusting forces. The leading edge of the thrust piece still acts as a clamping edge, and, in its clamping function for an emergency, it has sacrificed nothing in comparison with the known adjusting fittings. Instead, only the forces required to adjust the belt length have been reduced by the improved means of guiding the belt strip. Also, one-handed operation is made possible because the occupant has only to tilt the frame slightly with one hand with respect to the belt while he applies the pull on the belt, e.g. for the extension of the belt length, by bending his upper body forward. Even slight angles in the adjusting device according to the invention will produce optimum adjustment opportunity. In the case of an accident, a loading of the belt passed around the occupant will always produce a locking moment.

A preferred form of embodiment of the invention is characterized in that the thrust piece and the locking cap are two separate components, the locking cap having a profile web of approximately semi-circular cross-section and having on its outer faces cranked guide jaws which are displaceable together with the thrust piece on the narrow lateral faces of the frame, transversely to the longitudinal aperture thereof, the thrust piece being loosely insertable into the locking cap in such a way that the thrust piece comes to rest between the frame and the profiled web. Where this embodiment is concerned, it is advantageous that the usual simple thrust pieces made from sheet steel may be used, being held in and guided together with the locking cap, without the frame requiring a complicated stamped-out blank or even to be cranked during some special operation in its manufacture. Although the adjusting device according to the invention, without imposition of the safety function, offers the considerable advantage of reduced adjustment forces, only a few simple component parts are required so that competitively priced manufacture is possible.

According to the invention, it has been found particularly expedient for the locking cap to consist of synthetic plastics material, preferably polyamide, while the frame and the thrust piece ought to be of sheet steel and the clamping edge of the thrust piece should, together with the leading edge of the longitudinal aperture in the frame, form the locking slot. It goes without saying that also other synthetic plastics may be used for the locking cap and it is possible also to provide steel reinforcements or other measures to strengthen the locking cap if this is necessary. However, tests have shown that the cranked retaining jaws provided on the outside faces of the profile web exhibit outstanding breakage resistance when polyamide is used. The construction according to the invention has the further advantage that the belt strip emerging towards the side of the body prevents direct contact between the metal parts of the adjustable fitting and the body.

The synthetic plastics locking cap virtually covers the thrust piece and in addition to the improved belt guidance arrangement, by improving the looping around angle, provides a smooth surface so that the belt strip is not folded at the edges or folded around or deflected over rough or milled or knurled surfaces, as in the case of the known fittings but runs easily over the smooth rounded surface of the transverse or profiled web.

The invention is expediently further developed in that the frame has a preferably angled-off gripping panel on its front end. The frame can then easily be lifted out of the belt plane by slight thumb pressure.

According to the invention, it is also expedient for the under side of the transverse web of the thrust piece to be ribbed. In consequence, in the case of a sudden pull on the belt strip which is passed around the occupant, the friction is increased in addition to the clamping action.

The new adjusting device permits of reduced adjusting forces also for strip materials which, by virtue of particularly exacting demands in certain countries, are hard and have a rough surface.

Furthermore, a particular embodiment of the invention is characterized in that on the outside face of the profile web of the locking cap there are guide webs which overlap the profile web to a certain extent, a certain interval being left between them. The belt strip passes through between the profile web and the bilateral overlap. In this way, the belt is kept constantly bearing on the surface of the profile web. In this way, the so-called micro slip, i.e. the unintended adjustment of the safety belt due to vibration on the adjusting means, can be avoided.

Further features, advantages and possible applications of the present invention will become manifest from the following description which must be taken in conjunction with the drawings, in which.

Figure 1:
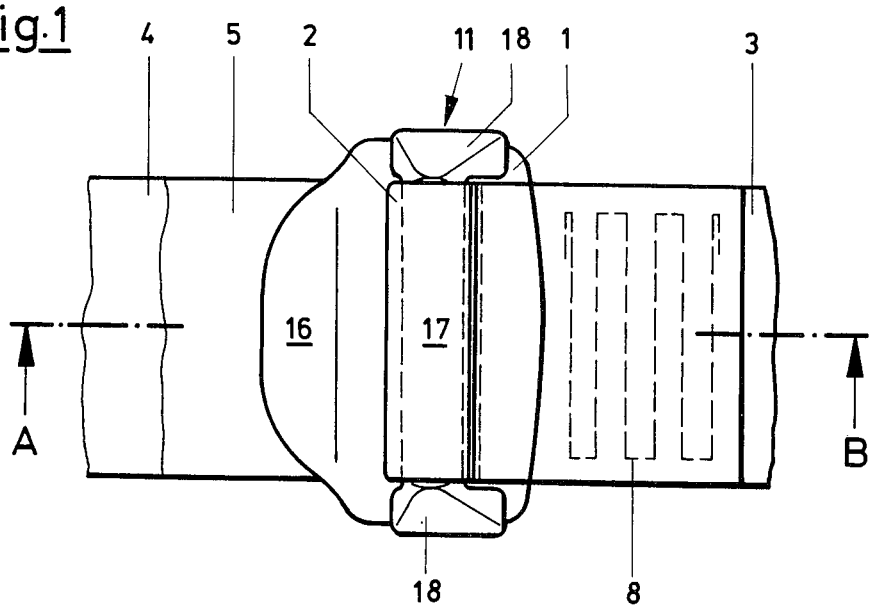
FIG. 1 is a plan view of the adjusting device with belt portions fitted.

Shown on the right in FIG. 1, on the frame 1 with the longitudinal aperture 2 is that belt strip 3 which, as its right-hand broken away and not shown end, is attached to the vehicle, preferably alongside the seat of the occupant.

On the opposite front side is shown the belt strip 4, of which one end is passed around the hip or shoulder of the occupant, while the other oppositely disposed free belt end 5 is riveted to a (not shown) synthetic plastics part which is slideably disposed on the other part 4 of the belt strip. The exact run of the belt is shown clearly in FIGS. 2 and 3. The free end 6 of the rearward belt strip 3 is passed from below through the longitudinal aperture 2, is pulled upwards and folded back around the long lateral face 7 (see FIGS. 2 and 3) and onto itself, being secured for example by a seam 8 according to FIG. 1. The front belt strip 4 is pulled up behind the transverse web 9 according to FIG. 3, through the longitudinal aperture 2, is passed around the transverse web 9 and is pulled downwards again through the longitudinal aperture 2 and then under the frame 1, on the left in the drawings.

The embodiment shown in the drawings constitutes a preferred embodiment having three component elements. The first element is the already-described frame 1. The second component is the thrust piece 10 shown in FIGS. 8 and 9 and the third component is the locking cap 11 shown in FIGS. 4 to 6.

Figure 8:
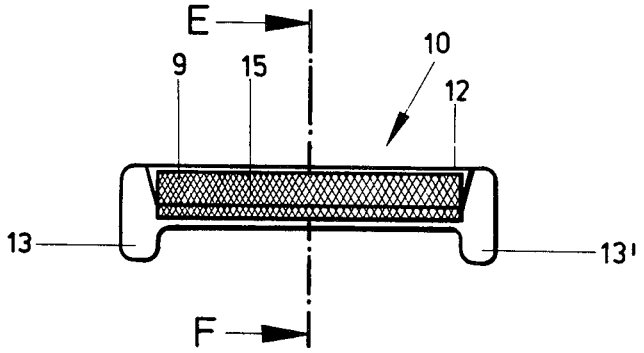
FIG. 8 is a view of the thrust piece from below.
Figure 9:
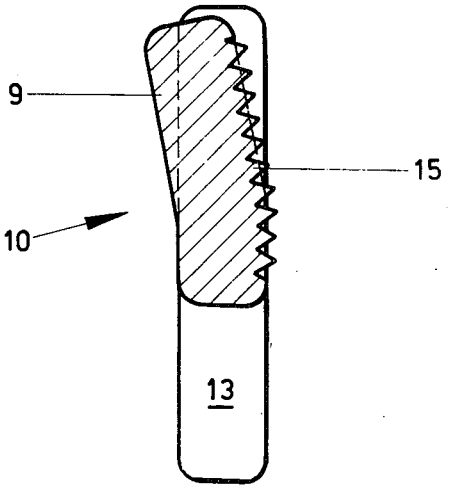
FIG. 9 is a section through the view in FIG. 8 on the line E–F.
Figure 10:
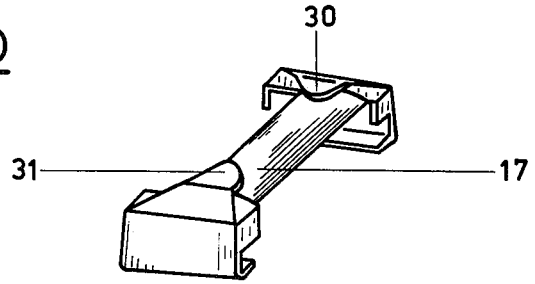
FIG. 10 shows a perspective view of a different embodiment of locking cap.
Figure 11:
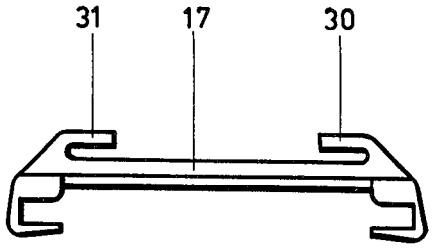
FIG. 11 is a cross-section through the locking cap in FIG. 10.
Figure 12:
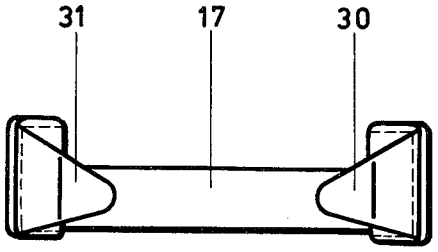
FIG. 12 is a plan view of the locking cap in FIGS. 10 and 11.
Figure 13:
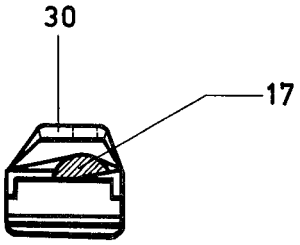
FIG. 13 is a cross-section through the locking cap according to FIGS. 10 and 12.

The thrust piece 10 shown in FIGS. 8 and 9 has a transverse web 9 with a locking edge 12 and lateral guide panels 13, 13'. FIG. 9 shows that the transverse web 9 is bent away or set at a small angle to the main plane of the thrust piece 10. In consequence, the clamping slot 14 shown in FIG. 3 does not, in the locked state, shear off the belt passed through it, because the clear locking action is adequate, as various series of tests has shown. As an additional measure to increase the friction and thus the locking action, the under side of the transverse web 9 is ribbed, as shown at 15. The length of the thrust piece 10 measured beyond the transverse web 9 and the guide panels 13, 13' is equal to the outer length of the frame 1.

Figure 3:
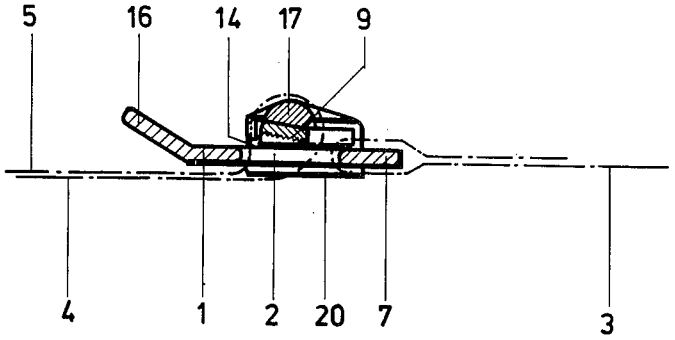
FIG. 3 is a sectional view on the line A–B in FIG. 1.
Figure 4:
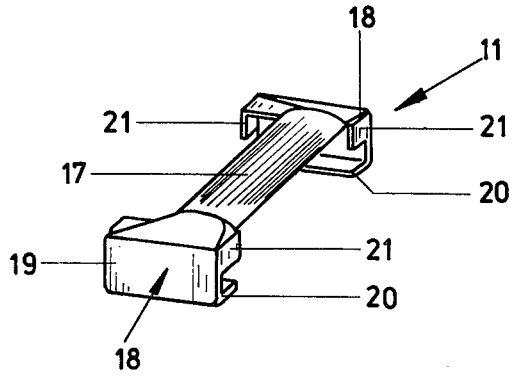
FIG. 4 is a perspective view of the locking cap.
Figure 5:
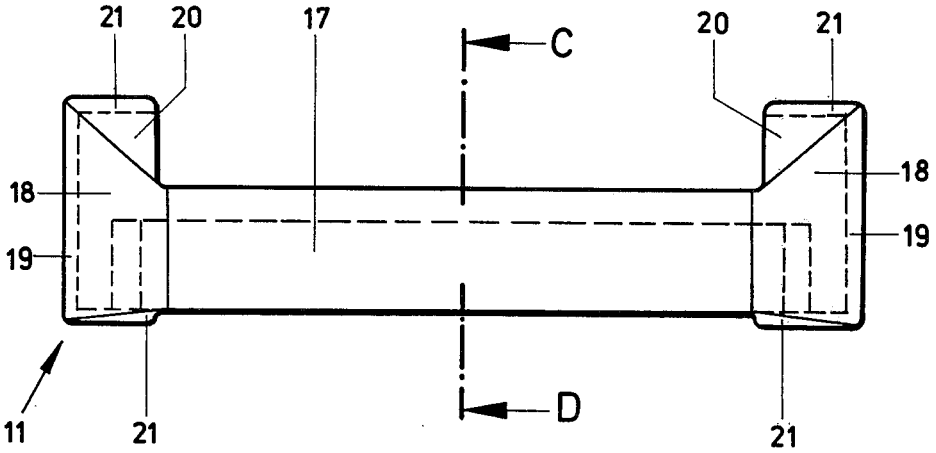
FIG. 5 is a plan view of the locking cap.
Figure 6:
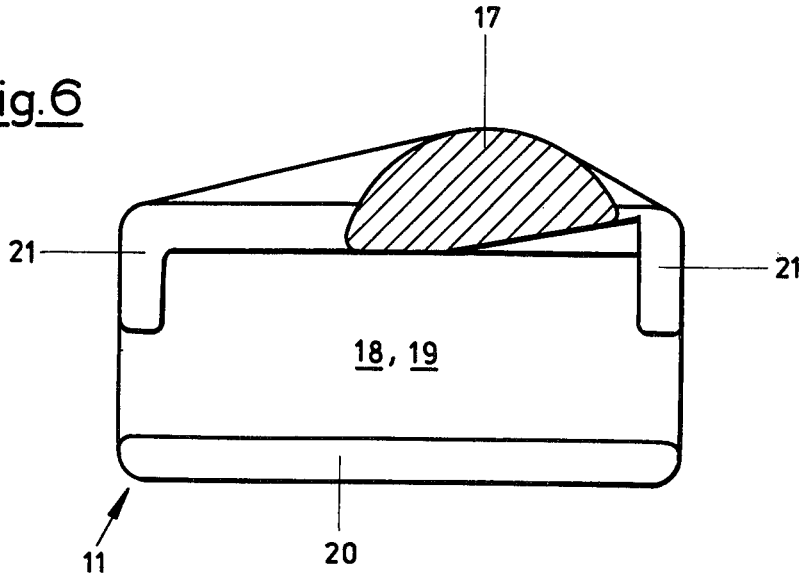
FIG. 6 is a section on the line D—D in FIG. 5.
Figure 7:
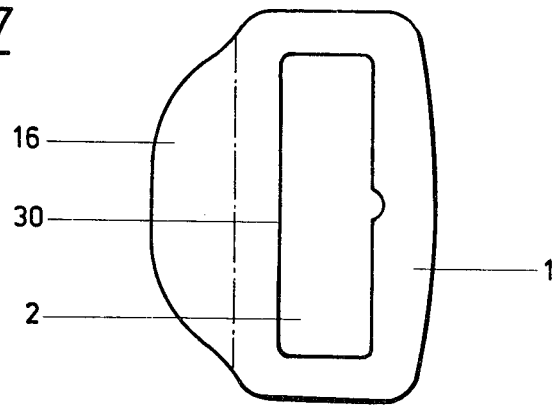
FIG. 7 is a plan view of the frame.

The locking cap is shown in FIGS. 4 to 6. It constitutes the third element of the preferred embodiment shown in the drawings and provides for guiding of the thrust piece 10 on the frame 1 which, as shown in FIG. 7 in conjunction with FIGS. 2 and 3, consists essentially of a flat steel plate with the stamped out longitudinal aperture 2, the embodiment shown in FIG. 7 also having an angled gripping pane 16. The plan view in FIG. 5 shows that, in plan view, the locking cap 11 has approximately the shape of the thrust piece 10. Instead of the transverse web 9 of the thrust piece, it has a profiled web 17 of approximately semi-circular cross-section and on the outside faces of which cranked guide jaw 18 are provided. The size of the locking cap 11 is such that it completely masks the thrust piece 10 when they are in superimposed relationship. The guide jaws 18 consist of lateral walls 19 which are bent over at the bottom through approximately 90° to form projections 20. From the side walls 19, short projections 21 also extend in the direction of the profile web 17, to ensure that, when pushed up from below against the profile web 17, the inserted thrust piece 10 is secured transversely thereto.

When in the foregoing description, it is stated that the side walls 19 are "bent over" to form projections 20, this expression does not include the possibility that in the case of the preferred embodiment in which the locking cap consists of plastics material, preferably polyamide, the entire locking cap is cast in one piece, the projections 20 then being naturally formed not by being "bent over" but being formed by casting or moulding in a mould.

Preferably, the locking cap is black and also the frame 1 may have a black surface sintered with synthetic plastics material. The thrust piece on the other hand, when the adjusting device is assembled, is not visible and may have a metal surface having a more or less bright appearance.

The adjusting device or adjustable fitting according to the invention is assembled in that first the thrust piece 10 is pushed into the locking cap 11 between projections 20 and profile web 17, then is pressed upwards against the profile web and between the short projections 21, and, in this state, is pushed together with the locking cap over the frame 1, so the position shown in FIG. 1 is assumed. The belts are then fitted and secured in the manner described at the outset.

Figure 2:
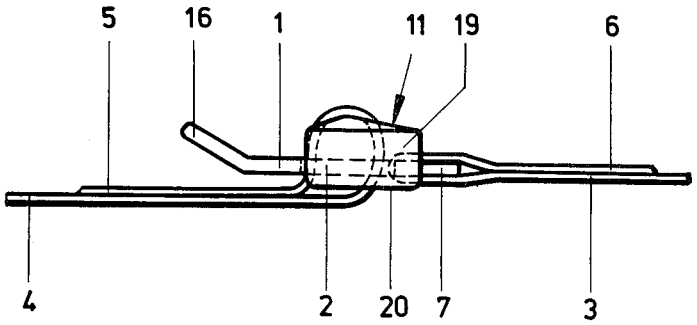
FIG. 2 is a side view of FIG. 1.

The adjusting device functions as follows:

The frame 1 is tilted out of the plane of the belt strips 3 to 6 by a slight lifting, for example by thumb pressure on the grip panel 16, so that the thrust piece 10 can move together with the locking cap 11 somewhat to the right in FIGS. 1 to 3. The locking slot 14 opens and for adjusting the length of the belt strip, the belt strip 4 can now be pulled to extend the belt. In order to shorten the belt, the aforesaid slight raising of the frame 1 is not necessary; it is necessary only to pull on the free belt strip 5. By reason of the approximately semi-circular configuration, shown particularly clearly in FIG. 6, i.e. by reason of the rounded surface of the profile web 17, the belt strip can be moved more easily in the open position, i.e. adjusted, because the looping-around angle for the belt strip is improved and the sharp kinking thereof, as in conventional adjustable fittings, over the rear edge of the transverse web 9, is avoided. The said facilitation of adjustment will be immediately obvious from FIGS. 2 and 3. In an emergency, ie. in the case of an impact of the motor vehicle, there is a sudden violent pull on the belt strip 4. As in the case of the known adjustable fittings, when this loading occurs, there is immediately a locking moment, i.e. the belt strip 4 pulls the transverse web 9 together with the profile web 17 (together with FIGS. 1 to 3) to the left, narrowing the locking slot 14, effecting a transposition of the transverse member 9 together with the profile web 17 and the frame 1, rendering any further movement for extending the belt strip 4 impossible.

The locking cap according to FIGS. 10 to 13 differs from that shown in FIGS. 4 to 6 only by virtue of the laterally overlapping guide webs 30 and 31. These are mounted on the outside faces of the profile web 17 and overlap the profile web somewhat, being disposed at a distance therefrom. The other parts of the locking cap are not described in greater detail since they have already been described in conjunction with the embodiment shown in FIGS. 4 to 6.

What is claimed is:

1. Apparatus for the adjustment of belt length, comprising a frame having a longitudinal aperture, thrust means mounted on and displaceable on the frame transversely with respect to the longitudinal aperture, said trust means including a plastic locking cap having a web of substantially semi-circular cross-section extending across said aperture and on an outer surface of said frame and guide jaws mounted over the longitudinal edges of said frame and displaceable with respect to the longitudinal aperture of the frame, said semi-circular surface facing outwardly of said outer surface, and further including a thrust piece loosely mounted in the locking cap and guided thereby and having a transverse web positioned across said aperture between said web and said frame and engageable with said web, said transverse web including an angled locking edge with relation to the main plane thereof and lateral guide panels extending transversely to the locking edge, said guide panels slidably engaging said outer surface of said frame along said aperture, said transverse web having ribs on the surface that face said aperture.

2. Apparatus according to claim 1, wherein the frame includes a gripper panel.

* * * * *

UNITED STATES PATENT AND TRADEMARK OFFICE

CERTIFICATE OF CORRECTION

PATENT NO. : 4,069,554

DATED : January 24, 1978

INVENTOR(S) : Horst Minolla and Uwe Peters

It is certified that error appears in the above-identified patent and that said Letters Patent are hereby corrected as shown below:

Column 1, line 4, delete the comma after "continuation".

Column 3, line 42, insert a comma after "fittings".

Column 6, line 35, "trust" should read -- thrust --.

Signed and Sealed this

Thirtieth Day of May 1978

[SEAL]

Attest:

RUTH C. MASON
Attesting Officer

LUTRELLE F. PARKER
Acting Commissioner of Patents and Trademarks